US012140360B2

(12) United States Patent
Hirayama

(10) Patent No.: US 12,140,360 B2
(45) Date of Patent: Nov. 12, 2024

(54) PULSE TUBE CRYOCOOLER

(71) Applicant: SUMITOMO HEAVY INDUSTRIES, LTD., Tokyo (JP)

(72) Inventor: Takashi Hirayama, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 95 days.

(21) Appl. No.: 17/949,218

(22) Filed: Sep. 21, 2022

(65) Prior Publication Data

US 2023/0034036 A1 Feb. 2, 2023

Related U.S. Application Data

(63) Continuation of application No. PCT/JP2021/005500, filed on Feb. 15, 2021.

(30) Foreign Application Priority Data

Mar. 23, 2020 (JP) ..... 2020-051333

(51) Int. Cl.
*F25B 9/14* (2006.01)

(52) U.S. Cl.
CPC ..... *F25B 9/145* (2013.01)

(58) Field of Classification Search
CPC ..... F25B 9/145
See application file for complete search history.

(56) References Cited

U.S. PATENT DOCUMENTS

| | | | |
|---|---|---|---|
| 10,060,656 B2 | 8/2018 | Tsuchiya et al. | |
| 10,066,855 B2 | 9/2018 | Xu et al. | |

FOREIGN PATENT DOCUMENTS

| | | | | |
|---|---|---|---|---|
| JP | 2001289523 A | | 10/2001 | |
| JP | 2005106297 A | * | 4/2005 | ..... F25B 9/145 |
| JP | 2008051408 A | | 3/2008 | |
| JP | 2012057871 A | | 3/2012 | |
| JP | 2014169852 A | | 9/2014 | |
| JP | 2016057013 A | | 4/2016 | |

* cited by examiner

*Primary Examiner* — Lionel Nouketcha
(74) *Attorney, Agent, or Firm* — HEA LAW PLLC

(57) ABSTRACT

A pulse tube cryocooler includes a pulse tube; a bidirectional flow path that is connected to the pulse tube, and through which a pulse tube inflow and a pulse tube outflow alternately flow; a DC flow generator that is disposed in the bidirectional flow path, causes a first pressure drop in the pulse tube inflow, and causes a second pressure drop different from the first pressure drop in the pulse tube outflow; and a flow rate regulator that is disposed in the bidirectional flow path in series with the DC flow generator, and adjusts flow rates of the pulse tube inflow and the pulse tube outflow.

6 Claims, 6 Drawing Sheets

PULSE TUBE CRYOCOOLER

RELATED APPLICATIONS

The contents of Japanese Patent Application No. 2020-051333, and of International Patent Application No. PCT/JP2021/005500, on the basis of each of which priority benefits are claimed in an accompanying application data sheet, are in their entirety incorporated herein by reference.

BACKGROUND

Technical Field

Certain embodiments of the present invention relate to a pulse tube cryocooler.

Description of Related Art

In a pulse tube cryocooler, there is a type in which a loop path for a refrigerant gas, which includes a pulse tube and a regenerator, is formed. A gas flow with a direct-current component, which is also referred to as a "DC flow", can be generated in the loop path. The DC flow affects the refrigeration performance of the pulse tube cryocooler. Therefore, in order to regulate the DC flow, a needle valve with an orifice incorporated therein is disposed in the loop path. This orifice is designed such that the geometric shape of the flow path differs according to a flow direction passing through the needle valve (refer to, for example, the related art).

SUMMARY

According to an embodiment of the present invention, there is provided a pulse tube cryocooler including: a pulse tube; a bidirectional flow path that is connected to the pulse tube, and through which a pulse tube inflow and a pulse tube outflow alternately flow; a DC flow generator that is disposed in the bidirectional flow path, causes a first pressure drop in the pulse tube inflow, and causes a second pressure drop different from the first pressure drop in the pulse tube outflow; and a flow rate regulator that is disposed in the bidirectional flow path in series with the DC flow generator, and adjusts flow rates of the pulse tube inflow and the pulse tube outflow.

DETAILED DESCRIPTION

Figure 1:
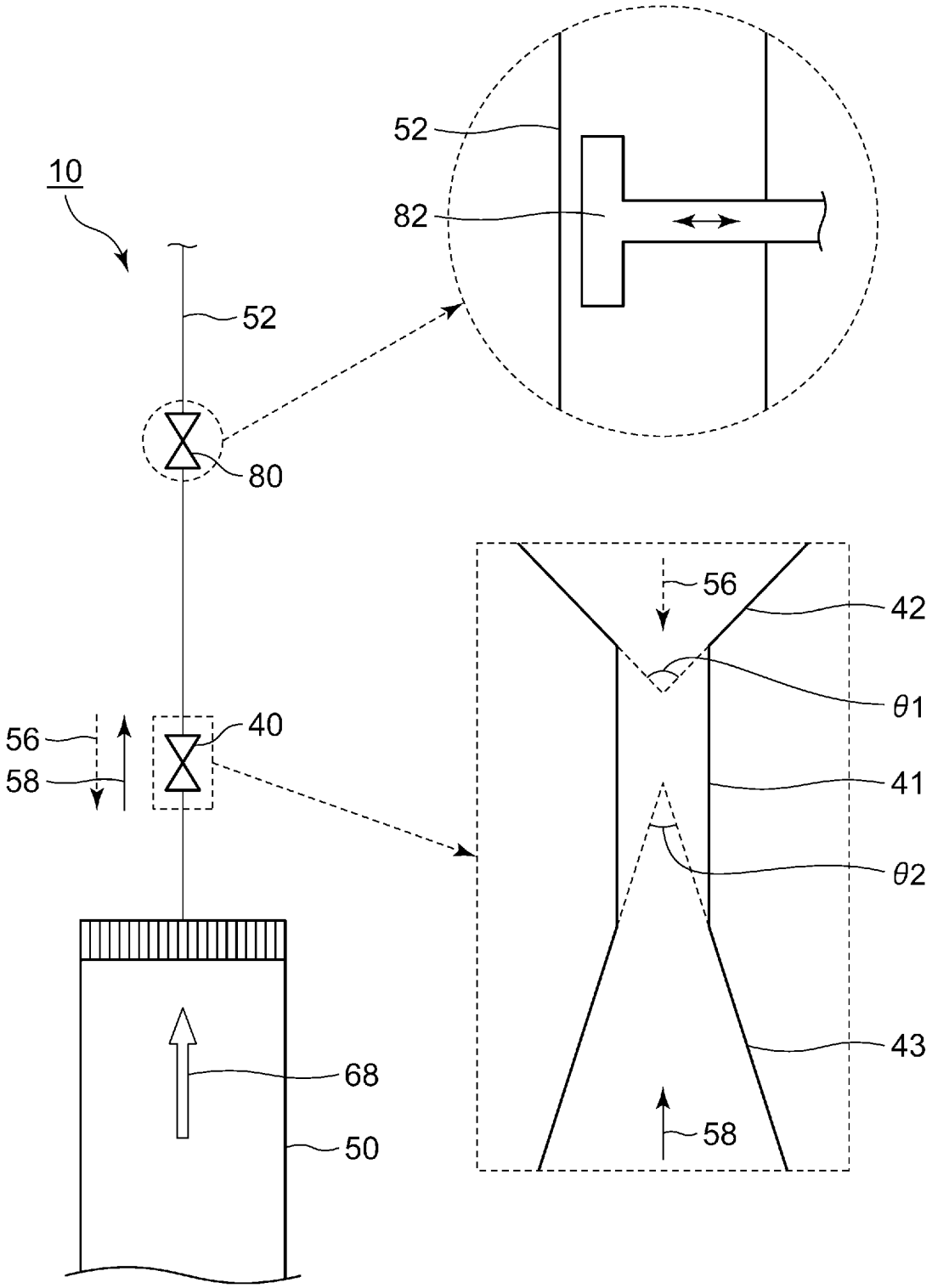
FIG. 1 is a diagram schematically showing a part of a pulse tube cryocooler according to an embodiment.

However, in the DC flow regulation mechanism described above, the shape of the flow path is complicated, the design and manufacture are complicated, and the cost is also high. Further, since the orifice for regulating the DC flow is incorporated in the needle valve, not only the DC flow changes when adjusting the position of the needle, but also the total flow rate passing through the needle valve changes depending on the needle position. In a situation where it is desired to independently regulate the flow rate and the DC flow, the difficulty of the regulation increases.

It is desirable to provide a simple configuration for regulating a DC flow of a pulse tube cryocooler.

Any combination of the above components or components or expressions of the present invention that are mutually replaced between methods, devices, systems, or the like are also effective as aspects of the present invention.

Hereinafter, embodiments for carrying out the present invention will be described in detail with reference to the drawings. In the description and drawings, identical or equivalent components, members, and processing are denoted by the same reference numerals, and overlapping description is omitted as appropriate. The scale or shape of each part that is shown in the drawings is conveniently set for ease of description and is not limitedly interpreted unless otherwise specified. The embodiments are exemplary and do not limit the scope of the present invention in any way. All features or combinations thereof described in the embodiments are not essential to the invention.

FIG. 1 is a diagram schematically showing a part of a pulse tube cryocooler 10 according to an embodiment. The pulse tube cryocooler 10 includes a pulse tube 50 and a bidirectional flow path 52 connected to the pulse tube 50. The bidirectional flow path 52 is connected to a high temperature end of the pulse tube 50, and allows the flow of a working gas (for example, helium gas) coming in and out of the pulse tube 50.

A DC flow generator 40 and a flow rate regulator 80 are disposed in series in the bidirectional flow path 52. In the example shown in FIG. 1, the flow rate regulator 80, the DC flow generator 40, and the high temperature end of the pulse tube 50 are connected in this order. However, the disposition of the flow rate regulator 80 and the DC flow generator 40 may be reversed, that is, the order of the DC flow generator 40, the flow rate regulator 80, and the high temperature end of the pulse tube 50 is also acceptable.

A pulse tube inflow 56 and a pulse tube outflow 58 alternately flow in the bidirectional flow path 52. The pulse tube inflow 56 and the pulse tube outflow 58 are working gas flows in opposite directions to each other. The pulse tube inflow 56 passes through the DC flow generator 40 from an inlet side thereof and flows into the pulse tube 50. The pulse tube outflow 58 flows out of the pulse tube 50 and passes through the DC flow generator 40 from an outlet side thereof. The pulse tube inflow 56 is generated in one part of a refrigeration cycle of the pulse tube cryocooler 10 (for example, a part of an intake process), and the pulse tube outflow 58 is generated in another part of the refrigeration cycle of the pulse tube cryocooler (for example, a part of an exhaust process).

As is known, in the pulse tube cryocooler 10, by appropriately delaying a phase of displacement oscillation of a gas element (also referred to as a gas piston) in the pulse tube 50 with respect to pressure oscillation of the working gas, it is possible to generate PV work at a low temperature end of the pulse tube 50 and cool a cooling stage provided at the low temperature end of the pulse tube 50. In this way, the pulse tube cryocooler 10 can cool a gas or liquid that is in contact with the cooling stage, or an object thermally coupled to the cooling stage. In a case where the pulse tube cryocooler 10 is a two-stage type, a first-stage cooling stage is cooled to, for example, a temperature less than 100 K (for example, a temperature in a range of about 30 K to 60 K), and a second-stage cooling stage is cooled to, for example, about 4 K or a temperature equal to or lower than 4 K. Various known configurations can be appropriately adopted for basic components of the pulse tube cryocooler 10, such as an oscillating flow generation source or a phase control mechanism. Some exemplary configurations are described later with reference to FIGS. 5 and 6.

The DC flow generator 40 causes a first pressure drop in the pulse tube inflow 56 and causes a second pressure drop different from the first pressure drop in the pulse tube outflow 58. The DC flow generator 40 has different flow path shapes on the inlet side and the outlet side. In this embodiment, the DC flow generator 40 includes a fixed orifice 41, a first tapered portion 42 on the inlet side of the fixed orifice 41, and a second tapered portion 43 on the outlet side of the fixed orifice 41. The orifice shape of the DC flow generator 40 is fixed.

The first tapered portion 42 connects the bidirectional flow path 52 to the fixed orifice 41. A flow path cross-sectional area of the first tapered portion 42 gradually decreases from the bidirectional flow path 52 to the fixed orifice 41 along a flow direction of the working gas. The fixed orifice 41 has a constant flow path cross-sectional area along the flow direction. The second tapered portion 43 connects the bidirectional flow path 52 to the fixed orifice 41 on the side opposite to the first tapered portion 42 in the flow direction. A flow path cross-sectional area of the second tapered portion 43 gradually decreases from the bidirectional flow path 52 to the fixed orifice 41 along the flow direction.

However, the first tapered portion 42 and the second tapered portion 43 have different taper angles from each other. A first taper angle θ1 of the first tapered portion 42 is different from a second taper angle θ2 of the second tapered portion 43. In this way, the first tapered portion 42 causes the first pressure drop in the pulse tube inflow 56, and the second tapered portion 43 causes the second pressure drop in the pulse tube outflow 58.

Supplementally, the fixed orifice 41 causes a contraction flow in the pulse tube inflow 56 and the pulse tube outflow 58. A pressure drop due to the contraction flow differs according to the shape of a flow path in which each of the pulse tube inflow 56 and the pulse tube outflow 58 flows into the fixed orifice 41.

In this embodiment, the pulse tube inflow 56 passes through the fixed orifice 41 from the first tapered portion 42, and on the other hand, the pulse tube outflow 58 passes through the fixed orifice 41 from the second tapered portion 43. The first taper angle θ1 of the first tapered portion 42 is larger than the second taper angle θ2 of the second tapered portion 43. It is believed that the larger the taper angle, the further the pressure drop that occurs in the flow passing through the fixed orifice 41 increases. Therefore, the first pressure drop occurring in the pulse tube inflow 56 is expected to be larger than the second pressure drop occurring in the pulse tube outflow 58.

According to a calculation example performed by the invention of the present invention, when the first taper angle 81 is 80 degrees and the second taper angle θ2 is 30 degrees, a pressure drop of 94.5 kPa occurs in the pulse tube inflow 56, and a pressure drop of 79.5 kPa occurs in the pulse tube outflow 58. Further, the maximum flow velocity of the pulse tube inflow 56 is 883 m/s, and the maximum flow velocity of the pulse tube outflow 58 is 812 m/s. In this calculation, a flow path diameter of the fixed orifice 41 is set to 0.6 mm, a flow path length is set to 0.5 mm, an inlet flow rate from the first tapered portion 42 is set to 3.96×10-5 kg/s, and outlet pressure of the second tapered portion 43 is set to 0 Pa, a fluid is set to helium gas (ideal gas), and the compressibility of the gas is taken into consideration.

In this manner, by making the taper angle to the fixed orifice 41 different between the inlet and the outlet of the DC flow generator 40, flow path resistances that are brought to the pulse tube inflow 56 and the pulse tube outflow 58 by the DC flow generator 40 can be made different. A difference in flow path resistance depending on the flow direction in the DC flow generator 40 generates a DC flow in the pulse tube cryocooler 10. In the calculation example described above, the pulse tube inflow 56 becomes more difficult to flow than the pulse tube outflow 58. In this case, according to the knowledge of the inventor of the present invention, a DC flow 68 from the low temperature end toward the high temperature end of the pulse tube 50 is promoted. The DC flow 68 can be regulated by properly designing the orifice shape of the DC flow generator 40.

If the DC flow generator 40 is disposed in the reverse direction in the bidirectional flow path 52, the DC flow in the reverse direction can be generated. That is, in a case where the pulse tube inflow 56 flows in from the second tapered portion 43 and the pulse tube outflow 58 flows in from the first tapered portion 42, a DC flow from the high temperature end toward the low temperature end of the pulse tube 50 is promoted.

In general, it is considered that the DC flow from the high temperature end toward the low temperature end of the pulse tube 50 is not desirable. This is because, in a case where the DC flow includes a working gas flow that penetrates from the high temperature end of the pulse tube to the low temperature end of the pulse tube, such a working gas flow causes heat intrusion from the high temperature end of the pulse tube to the low temperature end of the pulse tube, whereby the refrigeration efficiency of the pulse tube cryocooler 10 can be reduced.

However, for example, in a case where the pulse tube cryocooler 10 is large and the flow path resistance of a regenerator is large, or the like, due to the design of the pulse tube cryocooler 10, an excessive DC flow from the low temperature end toward the high temperature end of the pulse tube 50 can be generated and affect the refrigeration performance. In order to alleviate this, it is desired to generate a DC flow from the high temperature end toward the low temperature end of the pulse tube 50.

As described above, since the DC flow generator 40 can generate a DC flow from the high temperature end toward the low temperature end of the pulse tube 50, the excessive DC flow described above can be alleviated, so that it is possible to suppress a decrease in the refrigeration performance of the pulse tube cryocooler 10, which can be caused by the excessive DC flow.

Causing the pressure drops of different magnitudes in the pulse tube inflow 56 and the pulse tube outflow 58 is not limited to a difference in the taper angle between the inlet side and the outlet side. It is considered that due to a difference in the flow path shape between the inlet side and the outlet side of the DC flow generator 40, different pressure drops are caused in the pulse tube inflow 56 and the pulse tube outflow 58. Therefore, the DC flow generator 40 may have a first geometric flow path shape on the inlet side so as to cause the first pressure drop in the pulse tube inflow 56, and have a second geometric flow path shape on the outlet side so as to cause the second pressure drop different from the first pressure drop in the pulse tube outflow 58. The second geometric flow path shape is different from the first geometric flow path shape.

The flow rate regulator 80 adjusts the flow rates of the pulse tube inflow 56 and the pulse tube outflow 58. The flow rate regulator 80 may include a variable orifice that changes the flow path cross-sectional area of the bidirectional flow path. As an example, in the flow rate regulator 80, a valve body 82 movable in a direction perpendicular to the flow direction may be disposed in the bidirectional flow path. In this way, the flow rate regulator 80 may be capable of adjusting the flow rate of the working gas in the bidirectional flow path 52.

The flow rate regulator 80 is configured to cause an equal pressure drop in the pulse tube inflow 56 and the pulse tube outflow 58. The flow rate regulator 80 may have a symmetrical flow path shape on the inlet side and the outlet side. In this way, the flow rate regulator 80 is configured so as not to generate the DC flow 68.

According to the study of the inventor of the present invention, it has been found that the flow rate that is adjusted by the flow rate regulator 80 does not depend on the flow path shapes on the inlet side and the outlet side of the flow rate regulator 80 and depends only on the minimum flow path cross-sectional area of the flow rate regulator 80.

Therefore, the degree of interdependence between the flow rate and the DC flow is significantly reduced or eliminated by separately installing the DC flow generator 40 and the flow rate regulator 80. The DC flow 68 can be regulated by the design of the DC flow generator 40, and the flow rates of the pulse tube inflow 56 and the pulse tube outflow 58 can be adjusted by operating the flow rate regulator 80. It is easy to independently adjust the flow rate and the DC flow.

Since the flow rate regulator 80 is responsible for a function of adjusting the flow rate, that is, narrowing the flow path, the flow path cross-sectional area of the DC flow generator 40 (for example, the flow path cross-sectional area of the fixed orifice 41) may be larger than the flow path cross-sectional area of the flow rate regulator 80 (for example, the minimum flow path cross-sectional area that can be realized by the flow rate regulator 80). By separating the DC flow generator 40 and the flow rate regulator 80 from each other, it is permitted to design the flow path cross-sectional area of the DC flow generator 40 to be relatively large. This helps facilitate the manufacture of the DC flow generator 40.

Figure 2:
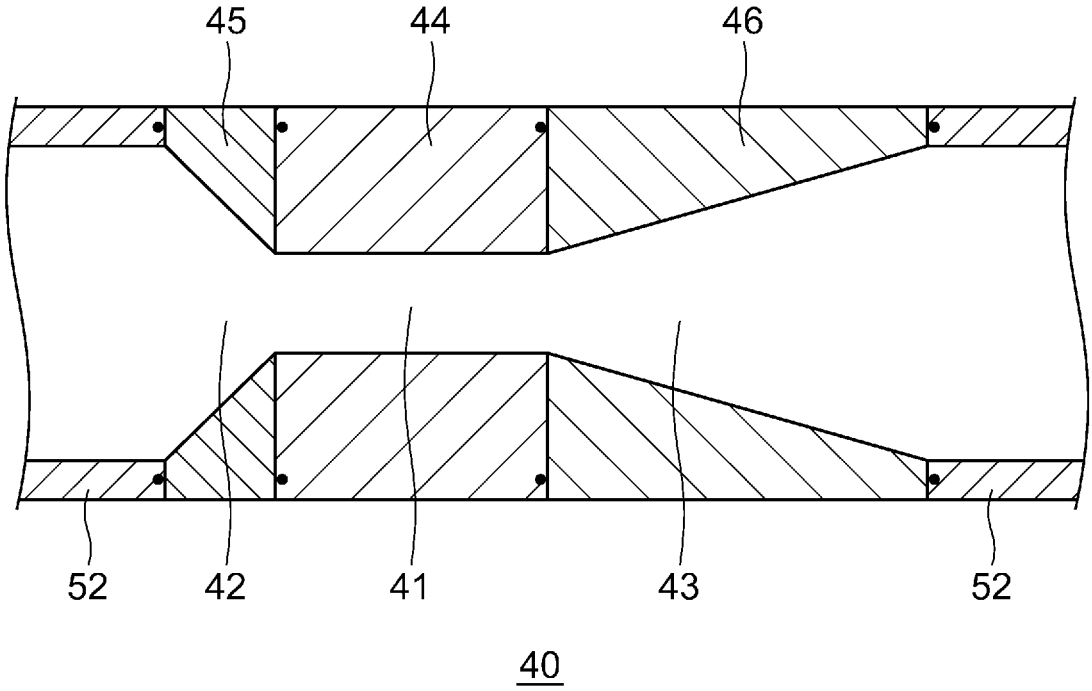
FIG. 2 is a diagram schematically showing an exemplary configuration of a DC flow generator according to the embodiment.

FIG. 2 is a diagram schematically showing an exemplary configuration of the DC flow generator 40 according to the embodiment. The DC flow generator 40 may include a fixed orifice component 44 having the fixed orifice 41, a first tapered flow path component 45 having the first tapered portion 42, and a second tapered flow path component 46 having the second tapered portion 43. The first tapered flow path component 45 is airtightly fixed to one side of the fixed orifice component 44, so that the first tapered portion 42 is connected to the fixed orifice 41. The second tapered flow path component 46 is airtightly fixed to the other side of the fixed orifice component 44, so that the second tapered portion 43 is connected to the fixed orifice 41. Further, each of the first tapered flow path component 45 and the second tapered flow path component 46 is airtightly fixed to the bidirectional flow path 52, whereby the DC flow generator 40 is installed in the bidirectional flow path 52. Each of the fixed orifice component 44, the first tapered flow path component 45, and the second tapered flow path component 46 may be dismountable and mountable.

A plurality of tapered flow path components having different taper angles may be prepared in advance. By replacing the tapered flow path component, the pressure drops that are caused in the pulse tube inflow 56 and the pulse tube outflow 58 by the DC flow generator 40 are adjusted, whereby it is possible to regulate the DC flow 68 of the pulse tube cryocooler 10.

Figure 3:
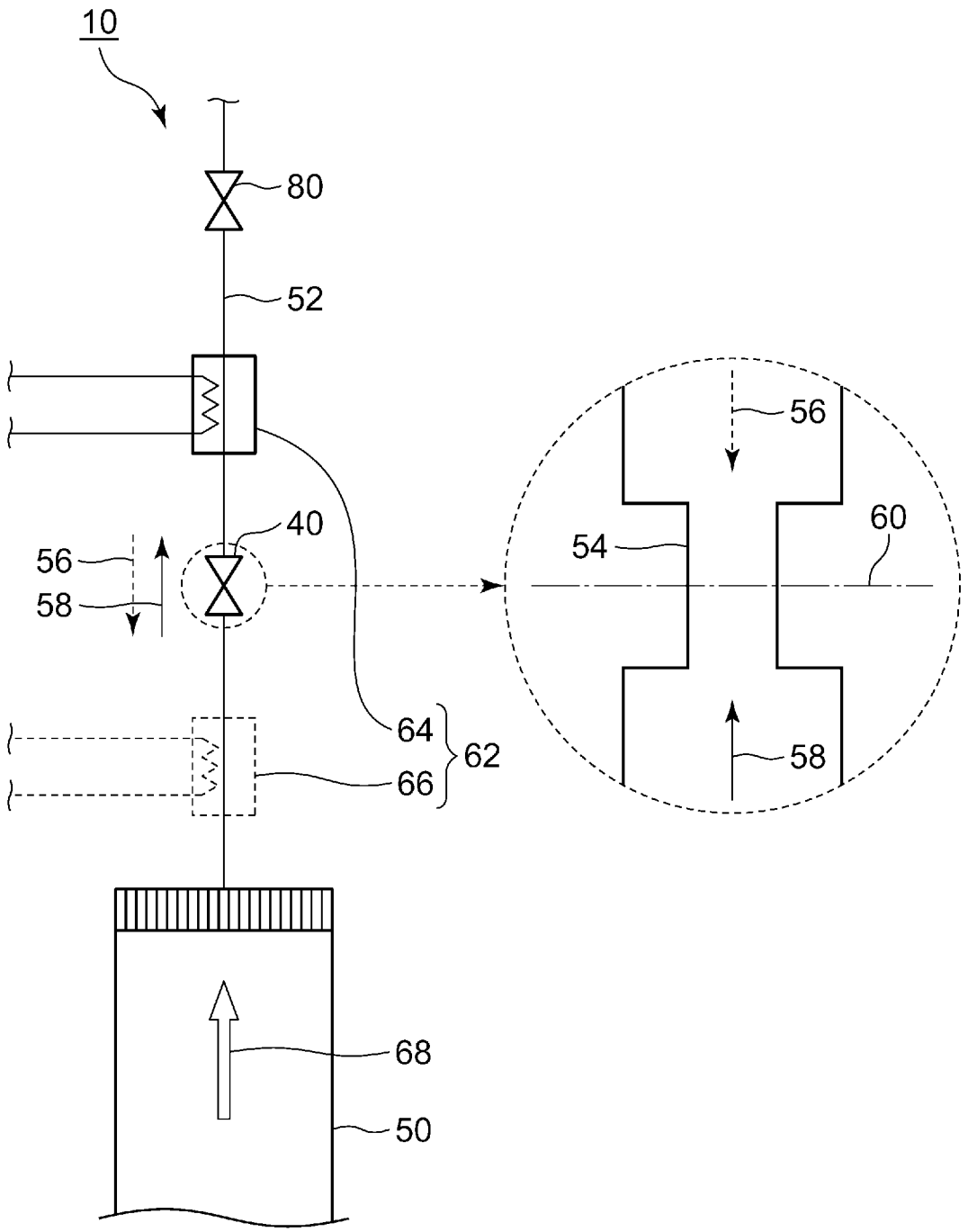
FIG. 3 is a diagram schematically showing a part of a pulse tube cryocooler according to another embodiment.

FIG. 3 is a diagram schematically showing a part of the pulse tube cryocooler 10 according to another embodiment. In this embodiment, the configuration of the DC flow generator 40 is different. The DC flow generator 40 includes a temperature regulator 62 provided in the bidirectional flow path 52 so as to adjust the pulse tube inflow 56 to a first temperature on the inlet side of the DC flow generator 40 and adjust the pulse tube outflow 58 to a second temperature different from the first temperature on the outlet side of the DC flow generator 40.

As described above, the DC flow generator 40 can generate the DC flow 68 by using the temperature regulator 62 without depending on the orifice shape. Therefore, it is no longer essential that the orifice shape of the DC flow generator 40 differs between the inlet side and the outlet side. Therefore, the DC flow generator 40 may be a simple fixed orifice having the same flow path shape on the inlet side and the outlet side. The fixed orifice is plane-symmetric with respect to a symmetry plane 60 that is orthogonal to the direction of the pulse tube inflow 56 and the pulse tube outflow 58 and passes through the center of the orifice.

The temperature regulator 62 includes a heater 64 that heats the pulse tube inflow 56 on the inlet side of the DC flow generator 40. The heater 64 is disposed in the bidirectional flow path 52 on the inlet side of the DC flow generator 40. The heater 64 may be an appropriate heating device such as an electric heater. Alternatively, the heater 64 may be a heating device that performs heating by utilizing exhaust heat from a component of the pulse tube cryocooler 10 that generates heat, such as a buffer volume or a compressor, or peripheral equipment. The heater 64 may be a heat exchanger that heats the working gas by heat exchange between a temperature control fluid having a temperature higher than that of the working gas and the working gas.

The pulse tube inflow 56 flows into the DC flow generator 40 in a state where it has been heated to a first temperature by the heater 64. Then, the pulse tube inflow 56 passes through the DC flow generator 40 and flows into the pulse tube 50 from the high temperature end of the pulse tube 50. Since a temperature around the high temperature end of the pulse tube 50 is an ambient temperature (for example, room temperature), the working gas flowing into the pulse tube 50 dissipates heat, so that the temperature thereof drops to a second temperature. The second temperature is lower than the first temperature. In this way, the pulse tube outflow 58 when flowing into the DC flow generator 40 from the outlet side of the DC flow generator 40 has a lower temperature than the pulse tube inflow 56 on the inlet side of the DC flow generator 40. The temperature of the working gas flow flowing into the DC flow generator 40 differs according to the direction of the flow.

Figure 4:
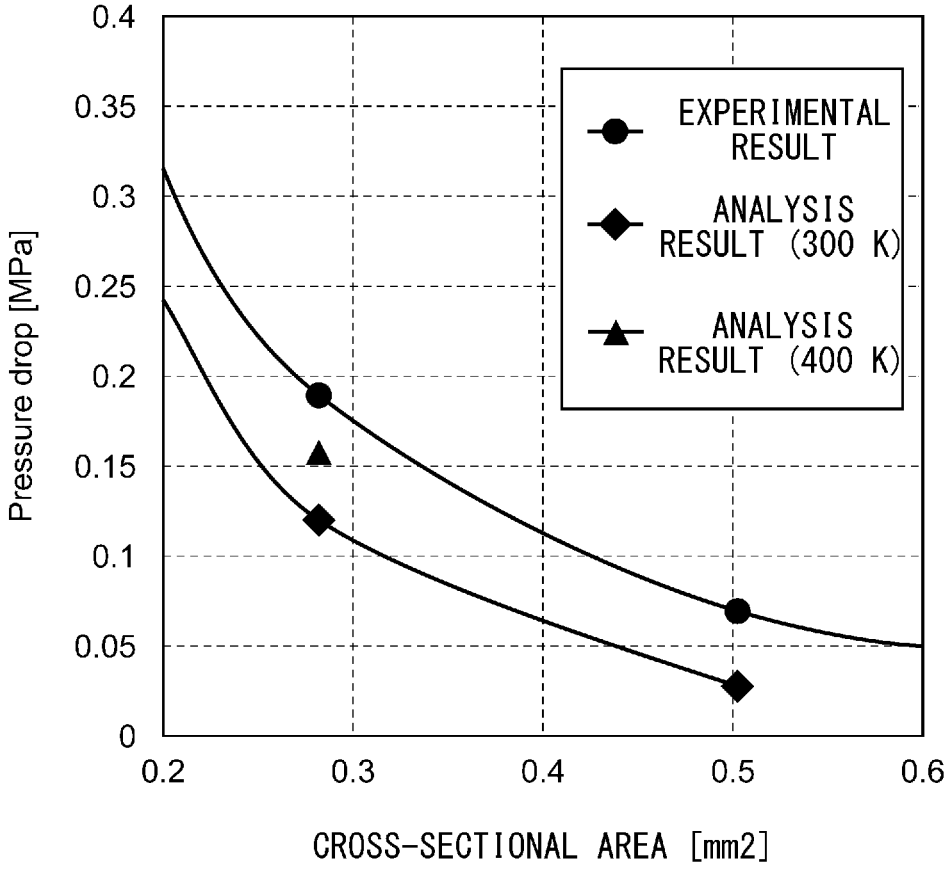
FIG. 4 is a graph showing temperature dependence of a pressure drop in the DC flow generator according to the embodiment.

FIG. 4 is a graph showing temperature dependence of a pressure drop in the DC flow generator 40 according to the embodiment. In FIG. 4, there are shown the results of analysis and experiment with respect to the flow path resistance occurring in a gas flow when helium gas passes through the DC flow generator 40 shown in FIG. 3. The horizontal axis indicates the minimum cross-sectional area ($mm^2$) of the DC flow generator 40, that is, the flow path cross-sectional area in the symmetry plane 60. The vertical axis indicates the flow path resistance (MPa) of the DC flow generator 40, which corresponds to the pressure on the inlet side when the outlet side of the DC flow generator 40 is at atmospheric pressure.

In FIG. 4, a triangular symbol indicates a calculation result in a case where the temperature of the gas flowing into the DC flow generator 40 is heated to 400 K, and a diamond-shaped symbol indicates a calculation result in a case where the temperature of the gas flowing into the DC flow generator 40 is 300 K. A circle indicates an experimental result.

Similar to the experimental results, the calculation results show that the larger the flow path cross-sectional area, the smaller the flow path resistance becomes. Therefore, the tendency of a change in the flow path resistance that is shown by the calculation results is supported by the experiment and evaluated as being reliable. Comparing the flow path resistance (about 0.11 MPa @ 0.28 $mm^2$) at 300 K with the flow path resistance (about 0.15 MPa @ 0.28 $mm^2$) at 400 K, the flow path resistance at 400 K is increased by about 1.3 times with respect to the flow path resistance at 300 K.

In this manner, by making the temperature of the gas flowing into the DC flow generator 40 different, the flow path resistance that the DC flow generator 40 causes in the gas flow passing therethrough can be made different. The difference in the flow path resistance depending on the flow direction in the DC flow generator 40 generates the DC flow 68 in the pulse tube cryocooler 10.

When the pulse tube inflow 56 has a first temperature (for example, 400 K) on the inlet side of the DC flow generator 40 and the pulse tube outflow 58 has a second temperature (for example, 300 K) on the outlet side of the DC flow generator 40, due to the difference in the flow path resistance of the DC flow generator 40, the pulse tube inflow 56 becomes more difficult to flow than the pulse tube outflow 58. In this case, according to the knowledge of the inventor of the present invention, the DC flow 68 from the low temperature end toward the high temperature end of the pulse tube 50 is promoted.

The temperature difference between the first temperature and the second temperature is 100 K in the example described above, and may be in the range of, for example, 50 K to 150 K. The temperature regulator 62 may be configured to generate a temperature difference, which is selected from this temperature range, between the pulse tube inflow 56 on the inlet side of the DC flow generator 40 and the pulse tube outflow 58 on the outlet side of the DC flow generator 40.

Further, the temperature regulator 62 may be configured to control the temperature difference. The temperature regulator 62 can control the DC flow 68 by changing the temperature difference to change the flow path resistance difference.

As shown in FIG. 3, the temperature regulator 62 may include a cooler 66 that cools the pulse tube outflow 58 on the outlet side of the DC flow generator 40. The cooler 66 is disposed in the bidirectional flow path 52 on the outlet side of the DC flow generator 40. The cooler 66 may be a liquid-cooled heat exchanger, an air-cooled heat exchanger, a cooler using a cooling element such as a Peltier element, for example, or another appropriate cooler.

By providing the cooler 66 in combination with the heater 64, it is possible to lower the heating temperature of the heater 64 for realizing a predetermined temperature difference. For example, when there is no cooler 66 and the working gas is at room temperature (for example, 20° C.) on the outlet side of the DC flow generator 40, the heater 64 has to heat the working gas to 120° C. in order to generate a temperature difference of 100° C. However, in a case where the cooler 66 cools the working gas to, for example, −20° C., it is sufficient if the heater 64 heats the working gas to 80° C. in order to generate a temperature difference of 100° C. The configuration of the heater 64 or the heat resistance of the pulse tube cryocooler 10 can be simplified.

Further, by not only adjusting the temperature of the working gas on the inlet side of the DC flow generator 40 by the heater 64, but also adjusting the temperature of the working gas on the outlet side of the DC flow generator 40 by the cooler 66, it is possible to more reliably control the temperature difference.

The pulse tube inflow 56 heated by the heater 64 can be cooled by the cooler 66 before flowing into the pulse tube 50. It is possible to prevent the gas from flowing into the pulse tube 50 at a high temperature and affecting the refrigeration performance of the pulse tube cryocooler 10.

The temperature regulator 62 can also generate a reverse DC flow by generating a temperature difference in the reverse direction. For example, the heater 64 and the cooler 66 are interchanged and disposed, whereby the first temperature becomes lower than the second temperature. The pulse tube inflow 56 on the inlet side of the DC flow generator 40 has a lower temperature than the pulse tube outflow 58 on the outlet side of the DC flow generator 40. The pulse tube outflow 58 becomes more difficult to flow than the pulse tube inflow 56, and a DC flow from the high temperature end toward the low temperature end of the pulse tube 50 is promoted.

Figure 5:
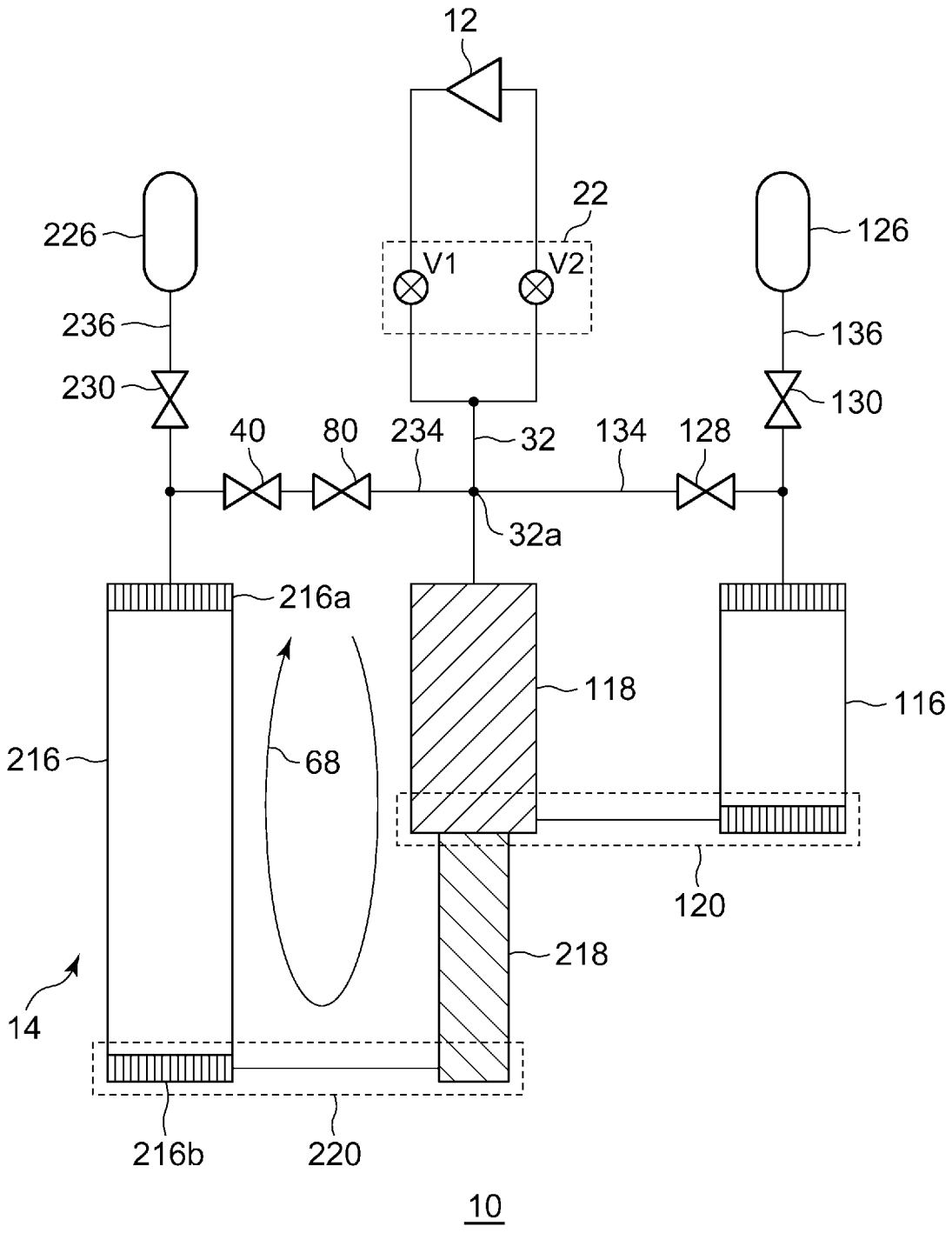
FIG. 5 is a diagram schematically showing a pulse tube cryocooler according to an embodiment.

FIG. 5 is a diagram schematically showing the pulse tube cryocooler 10 according to an embodiment. The pulse tube cryocooler 10 is a GM (Gifford-McMahon) type double inlet type two-stage pulse tube cryocooler, and the DC flow generator 40 described above is applied in order to adjust the DC flow of a second stage portion. Further, the flow rate regulator 80 is provided in series with the DC flow generator 40.

The pulse tube cryocooler 10 includes a compressor 12 and a cold head 14. The cold head 14 includes a main pressure switching valve 22, a first-stage pulse tube 116, a first-stage regenerator 118, a first-stage cooling stage 120, a first-stage buffer volume 126, a first-stage double inlet flow path 134, and a first-stage buffer line 136. The main pressure switching valve 22 is connected to the first-stage regenerator 118 by a regenerator communication passage 32. The first-stage double inlet flow path 134 is provided with a first-stage double inlet orifice 128, and the first-stage buffer line 136 is provided with a first-stage buffer orifice 130.

In addition, the pulse tube cryocooler 10 includes a second-stage pulse tube 216, a second-stage regenerator 218, a second-stage cooling stage 220, a second-stage buffer volume 226, a second-stage double inlet flow path 234, and a second-stage buffer line 236. The second-stage regenerator 218 is connected in series with the first-stage regenerator 118, and the low temperature end of the second-stage regenerator 218 communicates with a low temperature end **216*b* of the second-stage pulse tube 216**.

The second-stage double inlet flow path 234 connects the main pressure switching valve 22 to the second-stage pulse tube 216 so as to bypass the regenerators (118, 218). The second-stage double inlet flow path 234 corresponds to the bidirectional flow path 52 shown in FIG. 1, and the DC flow generator 40 and the flow rate regulator 80 are provided in the second-stage double inlet flow path 234. The second-stage double inlet flow path 234 is connected to a high temperature end 216*a* of the second-stage pulse tube 216 via the DC flow generator 40 and the flow rate regulator 80 from a branch portion 32*a* on the regenerator communication passage 32. The second-stage buffer line 236 is provided with a second-stage buffer orifice 230, and the second-stage buffer line 236 connects the second-stage buffer volume 226 to the high temperature end 216*a* of the second-stage pulse tube 216 via the second-stage buffer orifice 230.

Since the GM type double inlet type pulse tube cryocooler itself is well known, detailed description of each component of the pulse tube cryocooler 10 will be omitted.

The pulse tube cryocooler 10 shown in FIG. 5 has a loop path that includes the second-stage pulse tube 216, the second-stage double inlet flow path 234, and the regenerators (118, 218). Therefore, the DC flow 68 can be generated in this loop path. By providing the DC flow generator 40 in the second-stage double inlet flow path 234, it is possible to regulate the DC flow 68 of the pulse tube cryocooler 10. By providing the flow rate regulator 80 separately from the DC flow generator 40, it is possible to independently regulate the flow rate and the DC flow.

Since the pulse tube cryocooler 10 shown in FIG. 5 also has a loop path in the first stage, the DC flow generator 40 and the flow rate regulator 80 may be provided in the first-stage double inlet flow path 134.

Figure 6:
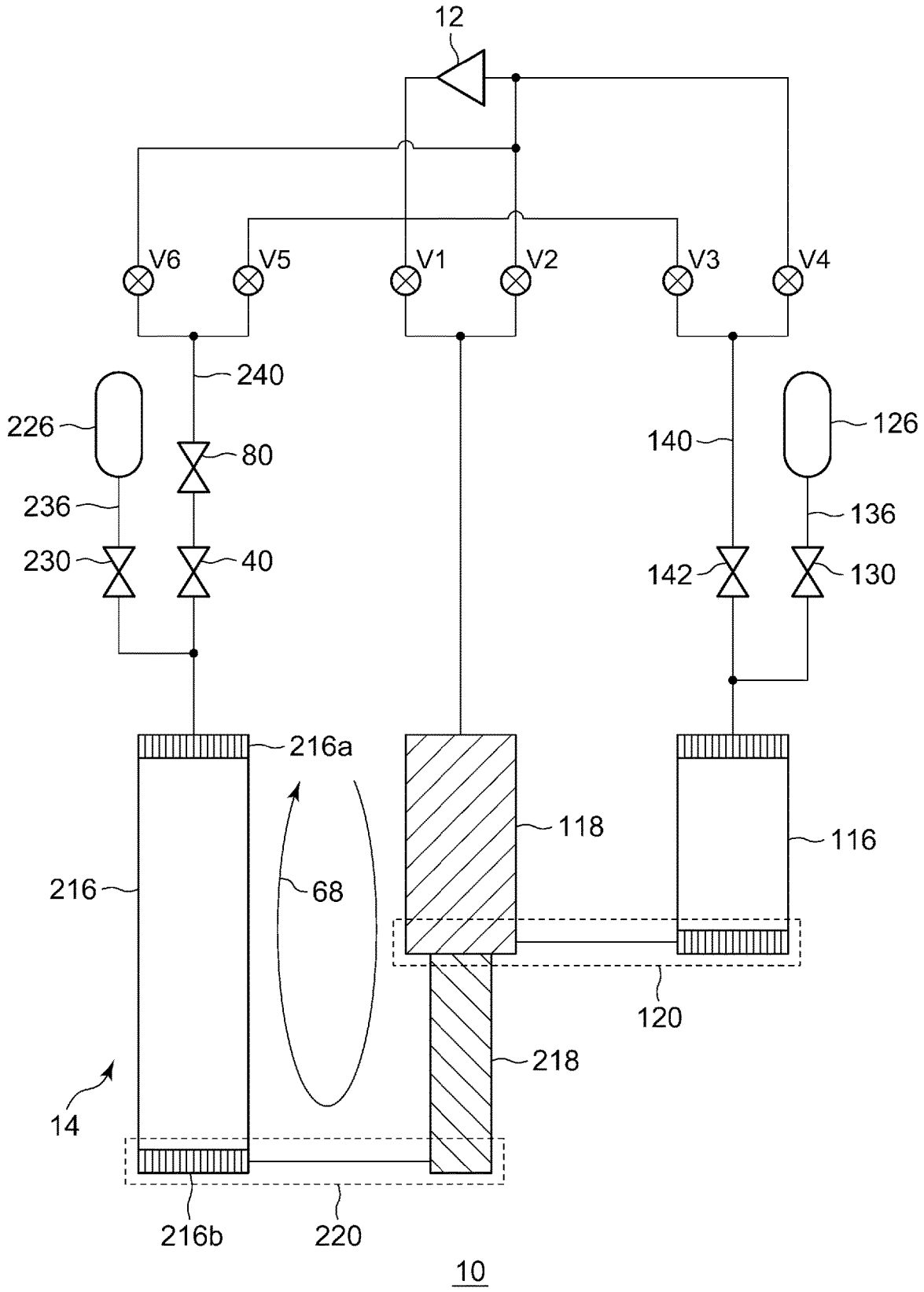
FIG. 6 is a diagram schematically showing another example of the pulse tube cryocooler according to an embodiment.

FIG. 6 is a diagram schematically showing another example of the pulse tube cryocooler 10 according to an embodiment. The pulse tube cryocooler 10 shown in FIG. 6 is a GM type four-valve type two-stage pulse tube cryocooler. Therefore, the pulse tube cryocooler 10 includes first-stage sub-pressure switching valves (V3, V4) and second-stage sub-pressure switching valves (V5, V6), instead of the double inlet flow path. In the following, the different configurations between the pulse tube cryocooler 10 shown in FIG. 5 and the pulse tube cryocooler 10 shown in FIG. 6 will be mainly described, and the common configurations will be briefly described or omitted.

The first-stage sub-pressure switching valves (V3, V4) alternately connect the high temperature end of the first-stage pulse tube 116 to a discharge port and a suction port of the compressor 12. The first-stage sub-pressure switching valves (V3, V4) are connected to the high temperature end of the first-stage pulse tube 116 by a first-stage pulse tube communication passage 140. The first-stage pulse tube communication passage 140 has a first-stage flow rate adjusting element 142. Similarly, the second-stage sub-pressure switching valves (V5, V6) alternately connect the high temperature end of the second-stage pulse tube 216 to the discharge port and the suction port of the compressor 12. The second-stage sub-pressure switching valves (V5, V6) are connected to the high temperature end of the second-stage pulse tube 216 by a second-stage pulse tube communication passage 240. The second-stage pulse tube communication passage 240 corresponds to the bidirectional flow path 52 shown in FIG. 1, and the DC flow generator 40 and the flow rate regulator 80 are provided in the second-stage pulse tube communication passage 240. Since the GM type four-valve type pulse tube cryocooler itself is well known, detailed description of each component of the pulse tube cryocooler 10 will be omitted.

The pulse tube cryocooler 10 shown in FIG. 6 has a loop path that includes the compressor 12, the second-stage pulse tube 216, and the regenerators (118, 218). Therefore, the DC flow 68 can be generated in this loop path. By providing the DC flow generator 40 in the second-stage pulse tube communication passage 240, it is possible to regulate the DC flow 68 of the pulse tube cryocooler 10. By providing the flow rate regulator 80 separately from the DC flow generator 40, it is possible to independently regulate the flow rate and the DC flow.

Since the pulse tube cryocooler 10 shown in FIG. 6 also has the loop path in the first stage, the DC flow generator 40 and the flow rate regulator 80 may be provided in the first-stage pulse tube communication passage 140.

The present invention has been described above based on the examples. It will be understood by those skilled in the art that the present invention is not limited to the above embodiments, various design changes can be made, various modification examples are possible, and such modification examples are also within the scope of the present invention. Various features described in relation to an embodiment are also applicable to other embodiments. New embodiments resulting from combinations have the effect of each of embodiments which are combined.

In the embodiments described above, the DC flow generator 40 and the flow rate regulator 80 are disposed adjacent to each other in the bidirectional flow path 52. However, in an embodiment, another component of the pulse tube cryocooler 10 may be provided between the DC flow generator 40 and the flow rate regulator 80. For example, it is also possible to connect the DC flow generator 40 to the high temperature end of the regenerator and connect the flow rate regulator 80 to the high temperature end of the pulse tube. That is, the regenerator, the cooling stage, and the pulse tube may be disposed between the DC flow generator 40 and the flow rate regulator 80. Alternatively, the DC flow generator 40 may be connected between the low temperature end of the regenerator and the low temperature end of the pulse tube. That is, the pulse tube may be disposed between the DC flow generator 40 and the flow rate regulator 80. In other words, the bidirectional flow path 52 in which the DC flow generator 40 and the flow rate regulator 80 are disposed may include the entire loop path in the pulse tube cryocooler 10. The DC flow generator 40 and the flow rate regulator 80 may be disposed at any place in the loop path as the bidirectional flow path 52.

In the embodiments described above, the double inlet type and four-valve type pulse tube cryocoolers have been described as examples. However, the separated disposition of the DC flow generator and the flow rate regulator 80 according to the present embodiment can also be applied to other pulse tube cryocoolers in which a loop path for the working gas including a pulse tube is formed. Further, the pulse tube cryocooler may be a single-stage type or a three-stage or other multi-stage type pulse tube cryocooler.

The present invention has been described using specific terms and phrases, based on the embodiments. However, the embodiments show only one aspect of the principles and applications of the present invention, and in the embodiments, many modifications or disposition changes are permitted within a scope which does not depart from the ideas of the present invention defined in the claims.

The present invention can be used in the field of pulse tube cryocoolers.

It should be understood that the invention is not limited to the above-described embodiment, but may be modified into various forms on the basis of the spirit of the invention. Additionally, the modifications are included in the scope of the invention.

What is claimed is:

1. A pulse tube cryocooler comprising:

a pulse tube;

a bidirectional flow path that is connected to the pulse tube, and through which a pulse tube inflow and a pulse tube outflow alternately flow;

a DC flow generator that is disposed in the bidirectional flow path, and causes a first pressure drop in the pulse tube inflow, and causes a second pressure drop different from the first pressure drop in the pulse tube outflow; and a flow rate regulator that is disposed in the bidirectional flow path in series with the DC flow generator, and adjusts flow rates of the pulse tube inflow and the pulse tube outflow;

wherein the DC flow generator includes a fixed orifice, a first tapered portion that causes the first pressure drop in the pulse tube inflow and is provided on an inlet side of the fixed orifice, and a second tapered portion that causes the second pressure drop in the pulse tube outflow and is provided on an outlet side of the fixed orifice, and the first tapered portion and the second tapered portion have different taper angles from each other; and wherein the flow rate regulator comprises a valve.

2. The pulse tube cryocooler according to claim 1, wherein the flow rate regulator is configured to cause an equal pressure drop in the pulse tube inflow and the pulse tube outflow.

3. The pulse tube cryocooler according to claim 1, wherein the flow rate regulator includes a variable orifice that changes a flow path cross-sectional area of the bidirectional flow path.

4. A pulse tube cryocooler comprising:

a pulse tube;

a bidirectional flow path that is connected to the pulse tube, and through which a pulse tube inflow and a pulse tube outflow alternately flow;

a DC flow generator that is disposed in the bidirectional flow path, and causes a first pressure drop in the pulse tube inflow, and causes a second pressure drop different from the first pressure drop in the pulse tube outflow;

a flow rate regulator that is disposed in the bidirectional flow path in series with the DC flow generator, and adjusts flow rates of the pulse tube inflow and the pulse tube outflow; and wherein the DC flow generator includes a temperature regulator provided in the bidirectional flow path to adjust the pulse tube inflow to a first temperature on an inlet side of the DC flow generator and adjust the pulse tube outflow to a second temperature different from the first temperature on an outlet side of the DC flow generator;

wherein the temperature regulator comprises a heater or a cooler; and wherein the flow rate regulator comprises a valve.

5. A pulse tube cryocooler comprising:

a pulse tube;

a bidirectional flow path that is connected to the pulse tube, and through which a pulse tube inflow and a pulse tube outflow alternately flow;

a DC flow generator that is disposed in the bidirectional flow path, and causes a first pressure drop in the pulse tube inflow, and causes a second pressure drop different from the first pressure drop in the pulse tube outflow;

a flow rate regulator that is disposed in the bidirectional flow path in series with the DC flow generator, and adjusts flow rates of the pulse tube inflow and the pulse tube outflow; and wherein the pulse tube cryocooler is a double inlet type two-stage pulse tube cryocooler, and the pulse tube is a second-stage pulse tube, the pulse tube cryocooler further comprises a regenerator connected to a low temperature end of the second-stage pulse tube, and the bidirectional flow path is a double inlet flow path connected to a high temperature end of the second-stage pulse tube by bypassing the regenerator; and wherein the flow rate regulator comprises a valve.

6. A pulse tube cryocooler comprising:

a pulse tube;

a bidirectional flow path that is connected to the pulse tube, and through which a pulse tube inflow and a pulse tube outflow alternately flow;

a DC flow generator that is disposed in the bidirectional flow path, and causes a first pressure drop in the pulse tube inflow, and causes a second pressure drop different from the first pressure drop in the pulse tube outflow; and a flow rate regulator that is disposed in the bidirectional flow path in series with the DC flow generator, and adjusts flow rates of the pulse tube inflow and the pulse tube outflow; and wherein the pulse tube cryocooler is a four-valve type two-stage pulse tube cryocooler, and the pulse tube is a second-stage pulse tube, the pulse tube cryocooler further comprises a compressor and a pressure switching valve that alternately connects a high temperature end of the second-stage pulse tube to a discharge port and a suction port of the compressor, and the bidirectional flow path connects the pressure switching valve to the high temperature end of the second-stage pulse tube; and wherein the flow rate regulator comprises a valve.

* * * * *